US007263848B2

(12) United States Patent
Bhatti

(10) Patent No.: US 7,263,848 B2
(45) Date of Patent: Sep. 4, 2007

(54) HEAT PUMP SYSTEM

(75) Inventor: Mohinder Singh Bhatti, Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 210 days.

(21) Appl. No.: 11/210,626

(22) Filed: Aug. 24, 2005

(65) Prior Publication Data

US 2007/0044500 A1 Mar. 1, 2007

(51) Int. Cl.
*F25B 13/00* (2006.01)

(52) U.S. Cl. ..... 62/160; 62/238.7; 62/324.1

(58) Field of Classification Search ..... 62/160, 62/238.7, 324.1, 196.4; 165/240
See application file for complete search history.

(56) References Cited

U.S. PATENT DOCUMENTS

| | | | | | |
|---|---|---|---|---|---|
| 4,454,725 | A * | 6/1984 | Cann | 62/117 |
| 5,095,972 | A * | 3/1992 | Nakaguro | 165/153 |
| 5,157,944 | A * | 10/1992 | Hughes et al. | 62/515 |
| 5,174,373 | A | 12/1992 | Shinmura | 165/176 |
| 5,247,805 | A * | 9/1993 | Dennis | 62/184 |
| 5,269,151 | A * | 12/1993 | Dinh | 62/81 |
| 5,695,004 | A * | 12/1997 | Beckwith | 165/104.21 |
| 5,782,101 | A | 7/1998 | Dennis | 62/186 |
| 5,826,649 | A | 10/1998 | Chapp et al. | 165/174 |
| 6,318,118 | B2 * | 11/2001 | Hanson et al. | 62/512 |
| 6,341,648 | B1 * | 1/2002 | Fukuoka et al. | 165/144 |
| 6,449,964 | B1 * | 9/2002 | Cho et al. | 62/114 |
| 6,810,949 | B1 * | 11/2004 | Staffa et al. | 165/135 |
| 6,883,341 | B1 * | 4/2005 | Lifson | 62/196.4 |
| 7,185,506 | B2 * | 3/2007 | Aflekt et al. | 62/324.6 |
| 2004/0103681 | A1 * | 6/2004 | Aflekt et al. | 62/278 |

FOREIGN PATENT DOCUMENTS

| | | | |
|---|---|---|---|
| GB | 2375596 | A | 11/2002 |
| GB | 2409510 | A | 6/2005 |
| JP | 2005-168134 | A * | 6/2005 |

* cited by examiner

*Primary Examiner*—Mohammad M. Ali
(74) *Attorney, Agent, or Firm*—Patrick M. Griffin

(57) ABSTRACT

A heat pump is operable in a heating mode and a cooling mode and includes two identical heat exchangers. The heat exchangers alternate between operating as a condenser and an evaporator as the heat pump switches between the heating mode and the cooling mode. The heat exchangers include a fluid passageway for directing a refrigerant therethrough and a bypass bisecting the fluid passageway into a first portion and a second portion. A valve interconnects the first portion and the second portion of the fluid passageway and the bypass for directing the refrigerant through the first portion of the fluid passageway and into the bypass to prevent refrigerant flow through the second portion of the fluid passageway when the heat exchanger is operable as the evaporator.

6 Claims, 2 Drawing Sheets

HEAT PUMP SYSTEM

BACKGROUND OF THE INVENTION

1. Field of the Invention

The subject invention relates to a heat pump system operable in a heating mode and a cooling mode.

2. Description of the Prior Art

Heat pumps have been utilized to heat and cool structures for many years. The heat pump includes a vapor compression system including a compressor, a condenser, an evaporator, an expansion device, and a refrigerant circulating through the system. In addition to the vapor compression system, the heat pump includes a reversing valve for reversing the flow of the refrigerant within the system. The heat pump removes heat from within the structure when the refrigerant is circulating in a direction, and adds heat to the structure when the circulation of the refrigerant is reversed. The condenser and the evaporator are both heat exchangers, with the refrigerant dissipating heat in the condenser and the refrigerant absorbing heat in the evaporator. The condenser and the evaporator each include at least one air movement device, such as a fan, to increase the airflow over the condenser and the evaporator to increase the operating efficiency of each.

When the heat pump is operating in the cooling mode, the condenser receives the refrigerant from the compressor in a vapor state. As the refrigerant circulates through the condenser, heat stored in the refrigerant is dissipated into the airflow passing across the condenser, thereby cooling the refrigerant. As the refrigerant cools in the condenser, it changes from the vapor state to a liquid state. The refrigerant, in the liquid state, moves from the condenser to the expansion device, where the pressure of the refrigerant is lowered to facilitate evaporation of the liquid refrigerant in the evaporator. The evaporator receives the liquid refrigerant from the expansion device at the lowered pressure. The airflow passes over the evaporator, where the refrigerant absorbs heat from the airflow, thereby evaporating the refrigerant and increasing the temperature of the refrigerant. The heated refrigerant, in the vapor state, circulates into the compressor, where the compressor compresses the vapor, thereby increasing the pressure of the vapor refrigerant to facilitate the phase change from the vapor state to the liquid state in the condenser. Additional heat is added to the refrigerant by the compressor during compression of the refrigerant. Therefore, the condenser must dissipate the heat in the refrigerant absorbed at the evaporator as well as the heat added to the refrigerant by the compressor. Accordingly, the heat exchanger operating as the condenser in the vapor compression system must have a heat transfer capacity higher than that of the heat exchanger operating as the evaporator in the vapor compression system.

When the reversing valve changes the direction of the refrigerant in the system to switch from the cooling mode to the heating mode, the condenser in the cooling mode becomes the evaporator in the heating mode, and the evaporator in the cooling mode becomes the condenser in the heating mode. The vapor compression system operates in the same manner as described above for the cooling mode. Accordingly, the heat transfer capacity of the two heat exchangers (the condenser and the evaporator) is reversed, and the heat exchanger operating as the evaporator in the heating mode may introduce more heat into the vapor compression system than the heat exchanger operating as the condenser is capable of dissipating. This results in an imbalance in the heat transfer rate between the evaporator and the condenser, undermining the system capacity and performance.

U.S. Pat. No. 5,782,101 to Dennis (the '101 patent) discloses a heat pump system operating in the heating mode as described above. The heat pump system further includes a sensor operatively connected to an evaporator fan. The sensor senses the temperature or the pressure of the refrigerant and sends a signal to the evaporator fan. The evaporator fan controls the airflow over the evaporator, thereby controlling the heat transfer rate of the evaporator. Accordingly, when the heat pump is operating in the heating mode and the temperature or the pressure of the refrigerant becomes too high, the sensor signals the fan to slow or disengage to reduce the airflow across the evaporator and limit the heat transferred to the refrigerant at the evaporator. As a result, in order to maintain a required mass flow rate of refrigerant circulating through the vapor compression system, the heat pump of the '101 patent reduces the velocity of the refrigerant circulating through the evaporator. The lower velocity of the refrigerant circulating through the evaporator lowers the efficiency of the heat pump system.

SUMMARY OF THE INVENTION AND ADVANTAGES

The subject invention provides a heat pump system that is operable in a heating mode and a cooling mode. The system comprises a compressor, an expansion device, a heat exchanger, and a circuit interconnecting the compressor, the expansion device, and the heat exchanger. The circuit directs a refrigerant therethrough in a direction. The circuit includes a flow directing mechanism for changing the direction the refrigerant circulates through the circuit, thereby changing the operation of the heat exchanger between an evaporator and a condenser to switch between the heating mode and the cooling mode. The heat exchanger defines a fluid passageway therethrough and includes a bypass bisecting the fluid passageway into a first portion and a second portion. The bypass is in fluid communication with the fluid passageway and the circuit. The heat exchanger includes a valve interconnecting the first portion and the second portion of the fluid passageway and the bypass. The valve includes a condenser position for opening fluid communication between the first portion and the second portion and closing fluid communication between the fluid passageway and the bypass. The condenser position directs the refrigerant through the fluid passageway when the heat exchanger is operable as the condenser. The valve also includes an evaporator position for closing fluid communication between the first portion and the second portion and opening fluid communication between the first portion and the bypass. The evaporator position directs the refrigerant back to the circuit and prevents the refrigerant from circulating through the second portion of the heat exchanger when the heat exchanger is operable as the evaporator.

Accordingly, the subject invention provides a heat pump system having a heat exchanger that is operable as both an evaporator and a condenser. The heat exchanger includes a reduced heat transfer rate when operating as the evaporator to balance the heat transfer rate with a heat transfer rate of a condenser. Therefore, the heat pump of the present invention maintains the velocity of the refrigerant through the heat exchanger to maintain the efficiency of the vapor compression system in both the heating mode and the cooling mode.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, a heat pump system is shown generally at 20.

Figure 1:
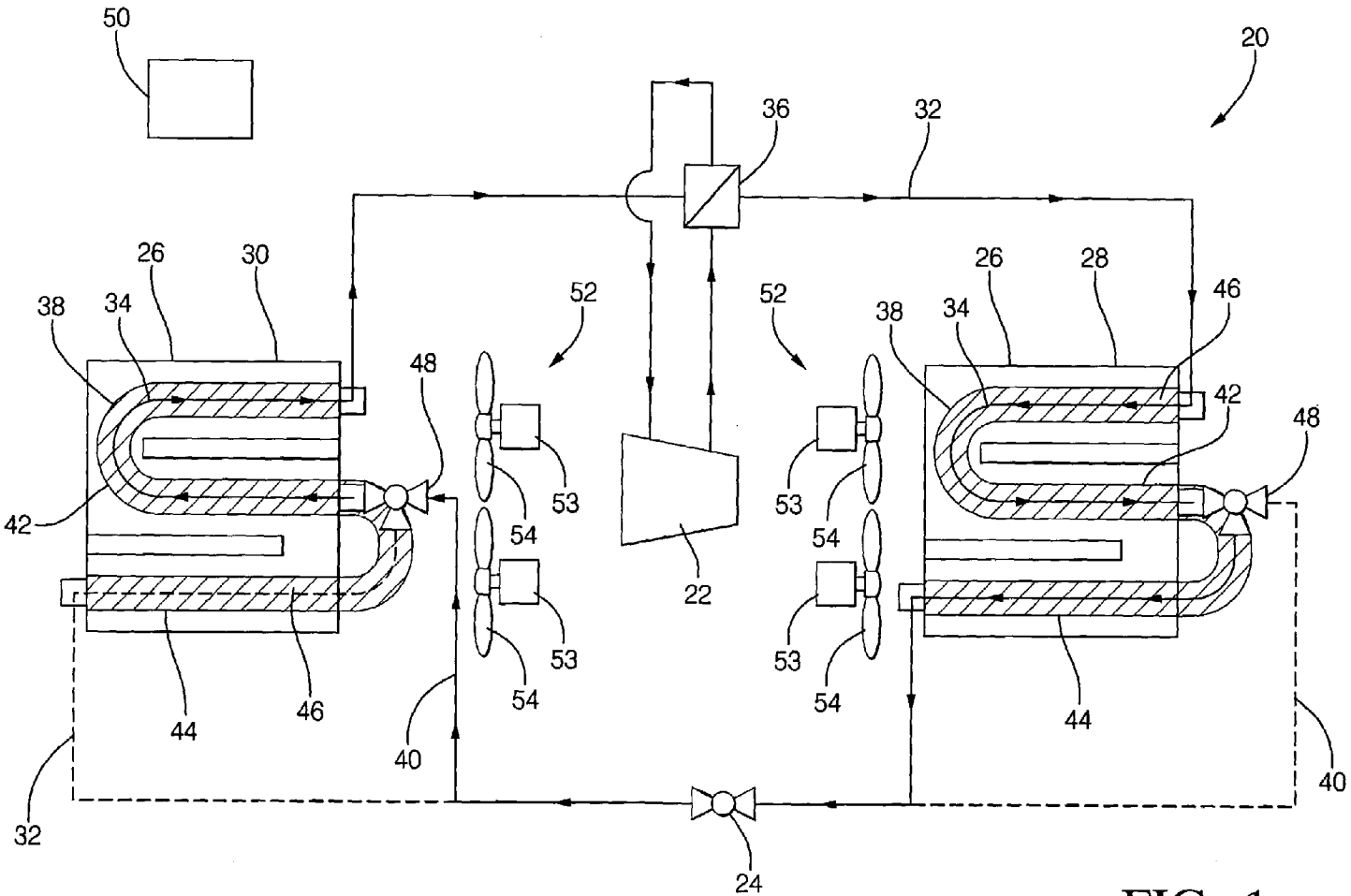
FIG. 1 is a schematic view of a heat pump system operating in the heating mode.
Figure 2:
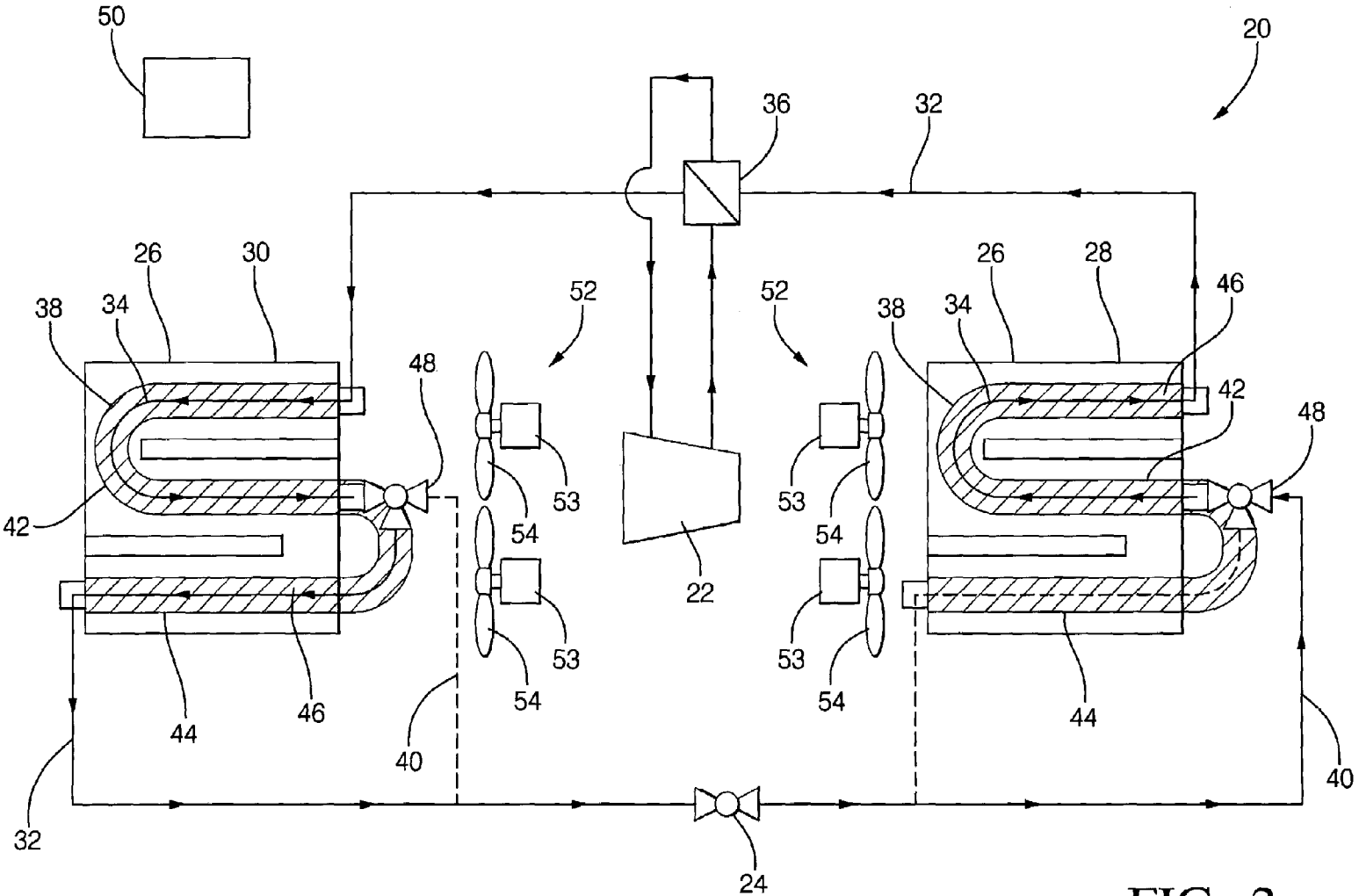
FIG. 2 is a schematic view of the heap pump system operating in the cooling mode.

Referring to FIGS. 1 and 2, the heat pump system 20 is operable in a heating mode and a cooling mode and includes a compressor 22, an expansion device 24, and a heat exchanger 26. The heat exchanger 26 includes a first heat exchanger 28 and a second heat exchanger 30 with the first heat exchanger 28 operable as the evaporator in the cooling mode and the condenser in the heating mode and the second heat exchanger 30 operable as the condenser in the cooling mode and the evaporator in the heating mode.

A refrigerant circuit 32 interconnects the compressor 22, the expansion device 24, and the first and second heat exchangers 28, 30. A refrigerant 34 circulates through the refrigerant circuit 32, including the compressor 22, the expansion device 24, and the first and second heat exchangers 28, 30, in a direction.

The refrigerant circuit 32 includes a flow directing mechanism 36 for changing the direction the refrigerant 34 circulates through the refrigerant circuit 32, the compressor 22, the expansion device 24, and the first and second heat exchangers 28, 30. The flow directing mechanism 36 thereby changes the operation of the first and second heat exchangers 28, 30 between one of the evaporator and the condenser to switch between the heating mode and the cooling mode.

The first and second heat exchangers 28, 30 are identical in their construction, with the first heat exchanger 28 including a thermal capacity and the second heat exchanger 30 including a thermal capacity equal to the thermal capacity of the first heat exchanger 28. The first and second heat exchangers 28, 30 each define a fluid passageway 38 therethrough, and include a bypass 40 bisecting the fluid passageway 38 into a first portion 42 and a second portion 44. The bypass 40 is in fluid communication with the first portion 42 and the second portion 44 of the fluid passageway 38 and the refrigerant circuit 32. The fluid passageway 38 includes a plurality of refrigerant tubes 46 evenly distributed throughout the fluid passageway 38, with at least one of the refrigerant tubes 46 in each of the first portion 42 and the second portion 44 of the fluid passageway 38.

The heat exchanger 26 includes a valve 48 interconnecting the first portion 42 and the second portion 44 of the fluid passageway 38 and the bypass 40. The valve 48 includes a condenser position for opening fluid communication between the first portion 42 and the second portion 44 of the fluid passageway 38 and closing fluid communication between the fluid passageway 38 and the bypass 40. The condenser position directs the refrigerant 34 through the fluid passageway 38 when the heat exchanger 26 is operable as the condenser. Additionally, the valve 48 includes an evaporator position for closing fluid communication between the first portion 42 and the second portion 44 of the fluid passageway 38 and opening fluid communication between the first portion 42 of the fluid passageway 38 and the bypass 40. The evaporator position directs the refrigerant 34 back to the refrigerant circuit 32 and prevents the refrigerant 34 from circulating through the second portion 44 of the heat exchanger 26 when the heat exchanger 26 is operable as the evaporator.

The heat pump system 20 includes a control mechanism 50 operatively connected to the flow directing mechanism 36. The control mechanism 50 is also operatively connected to the valve 48 of the first heat exchanger 28 and the valve 48 of the second heat exchanger 30. The control mechanism 50 controls the position of the flow directing mechanism 36, as well as the position of the valve 48.

The system includes an air movement device generally shown at 52, and operatively connected to the control mechanism 50. The air movement device 52 supplies a flow of air across the first heat exchanger 28 and the second heat exchanger 30. The air movement device 52 includes a plurality of fans 54 and a plurality of motors 53 with at least one fan 54 supplying the flow of air to the first heat exchanger 28 and at least one other fan 54 supplying the flow of air to the second heat exchanger 30. When the heat exchanger 26 is operable as the evaporator, at least one of the fans 54 adjacent the second portion 44 of the fluid passageway 38 is disengaged to conserve energy.

Referring to FIG. 2, during operation of the heat pump in the cooling mode, the second heat exchanger 30 is operable as the condenser and is generally located outside of the structure. The second heat exchanger 30 (condenser) receives the refrigerant 34 from the compressor 22 in a vapor state. As the refrigerant 34 circulates through the first portion 42 and the second portion 44 of the fluid passageway 38 of the second heat exchanger 30 (condenser), heat stored in the refrigerant 34 is dissipated into the flow of air passing across the second heat exchanger 30 (condenser), thereby cooling the refrigerant 34. It should be understood that the valve 48 of the second heat exchanger 30 is in the condenser position, thereby closing fluid communication between the fluid passageway 38 of the second heat exchanger 30 and the bypass 40. As the refrigerant 34 cools in the second heat exchanger 30 (condenser), the refrigerant 34 changes from the vapor state to a liquid state. The refrigerant 34, in the liquid state moves from the second heat exchanger 30 (condenser) to the expansion device 24, where the pressure of the refrigerant 34 is lowered to facilitate evaporation of the liquid refrigerant 34 in the first heat exchanger 28 operating as the evaporator. The first heat exchanger 28 (evaporator) is generally located within the structure and receives the liquid refrigerant 34 from the expansion device 24 at the lowered pressure. The air movement device 52 draws the flow of air from within the structure and passes the flow of air across the first heat exchanger 28 (evaporator), where the refrigerant 34 absorbs heat form the flow of air, thereby removing heat form the air within the structure. The refrigerant 34 circulates through the bypass 40 and into the first portion 42 of the fluid passageway 38 of the first heat exchanger 28 (evaporator), with the valve 48 preventing circulation through the second portion 44 of the first heat exchanger 28 (evaporator). It should be understood that the valve 48 of the first heat exchanger 28 is in the evaporator position, thereby closing fluid communication between the first portion 42 and the second portion 44 of the fluid passageway 38. The second portion 44 of the fluid passageway 38 in the first heat exchanger 28 (evaporator) is utilized as an accumulator to store an excess of the refrigerant 34 in the vapor compression system. As the temperature of the refrigerant 34 increases in the first heat exchanger 28 (evaporator), the liquid refrigerant 34 changes back into the vapor state. The heated refrigerant 34 in the vapor state circulates from the first heat exchanger 28 (evaporator) into the compressor 22, where the compressor 22 compresses the vapor refrigerant 34 to facilitate the phase change from the vapor state to the liquid state in the second heat exchanger 30 (condenser).

Referring to FIG. 1, during operation of the heat pump in the heating mode, the first heat exchanger 28 is operable as the condenser and is generally located within the structure. The first heat exchanger 28 (condenser) receives the refrigerant 34 from the compressor 22 in a vapor state. As the refrigerant 34 circulates through the first portion 42 and the second portion 44 of the fluid passageway 38 of the first heat exchanger 28 (condenser), heat stored in the refrigerant 34 is dissipated into the flow of air. The flow of air is drawn from within the structure and passed across the first heat exchanger 28 (condenser) by the air movement device 52, thereby cooling the refrigerant 34 and heating the air within the structure. It should be understood that the valve 48 of the first heat exchanger 28 is in the condenser position, thereby closing fluid communication between the fluid passageway 38 of the first heat exchanger 28 (condenser) and the bypass 40. As the refrigerant 34 cools in the first heat exchanger 28 (condenser), the refrigerant 34 changes from the vapor state to a liquid state. The refrigerant 34, in the liquid state moves from the first heat exchanger 28 (condenser) to the expansion device 24, where the pressure of the refrigerant 34 is lowered to facilitate evaporation of the liquid refrigerant 34 in the second heat exchanger 30 operating as the evaporator. The second heat exchanger 30 (evaporator) is generally located outside of the structure and receives the liquid refrigerant 34 from the expansion device 24 at the lowered pressure. The air movement device 52 passes the flow of air across the second heat exchanger 30 (evaporator), where the refrigerant 34 absorbs heat form the flow of air. The refrigerant 34 circulates through the first portion 42 of the fluid passageway 38 of the second heat exchanger 30 and is then directed to the bypass 40 by the valve 48, which prevents circulation through the second portion 44 of the fluid passageway 38 of the second heat exchanger 30 (evaporator). It should be understood that the valve 48 of the second heat exchanger 30 is in the evaporator position, thereby closing fluid communication between the first portion 42 and the second portion 44 of the fluid passageway 38. The second portion 44 of the fluid passageway 38 in the second heat exchanger 30 (evaporator) is utilized as an accumulator to store an excess of the refrigerant 34 in the vapor compression system. As the temperature of the refrigerant 34 increases, the liquid refrigerant 34 changes back into the vapor state. The heated refrigerant 34 in the vapor state circulates from the bypass 40 into the compressor 22, where the compressor 22 compresses the vapor refrigerant 34 to facilitate the phase change from the vapor state to the liquid state in the first heat exchanger 28 (condenser).

The precise location of the valve 48 in the heat exchanger 26 is determined by the design considerations of the heat pump. Based on the overall energy balance consideration, the thermal capacity, i.e., heat dissipation rate of the heat exchanger 26 operating as the condenser ($\dot{q}_{cond}$) is related to the thermal capacity, i.e., heat absorption rate of the heat exchanger 26 operating as the evaporator ($\dot{q}_{evap}$), and is expressed by the equation:

$$\dot{q}_{cond}=\dot{q}_{evap}+\dot{q}_{comp} \tag{1}$$

where $\dot{q}_{comp}$ is a heat generation rate in the compressor 22.

The heat generation rate in the compressor 22 $\dot{q}_{comp}$ can be expressed in terms of the heat absorption rate of the evaporator ($\dot{q}_{evap}$) and a coefficient of performance (COP) of the vapor compression system. The coefficient of performance (COP) is defined by the equation:

$$COP=\frac{\dot{q}_{evap}}{\dot{q}_{comp}} \tag{2}$$

Introducing equation 2 into equation 1, a thermal capacity difference between the condenser and the evaporator may be expressed by the equation:

$$\dot{q}_{cond}-\dot{q}_{evap}=\frac{\dot{q}_{evap}}{COP} \tag{3}$$

It follows from equation 3 that a ratio of the thermal capacity of the evaporator ($\dot{q}_{evap}$) to the thermal capacity of the condenser ($\dot{q}_{cond}$) is expressible in terms of the coefficient of performance (COP) as given by the following equation.

$$\frac{\dot{q}_{evap}}{\dot{q}_{cond}}=\frac{COP}{1+COP} \tag{4}$$

Assuming that the thermal capacity of the first and second heat exchangers 28, 30 are proportional to the number of refrigerant tubes 46 in the fluid passageway 38 of the first and second heat exchangers 28, 30, we can express the thermal capacity of the heat exchanger 26 operating as the condenser ($\dot{q}_{cond}$) and the thermal capacity of the heat exchanger 26 operating as the evaporator ($\dot{q}_{evap}$) by the equation:

$$\frac{\dot{q}_{evap}}{\dot{q}_{cond}}=\frac{n_{evap}}{n_{tot}} \tag{5}$$

where $n_{evap}$ is the number of refrigerant tubes 46 required for the first portion 42 of the fluid passageway 38 of the heat exchanger 26 operating as the evaporator; and $n_{tot}$ is the total number of refrigerant tubes 46 in the fluid passageway 38 of the first and second heat exchangers 28, 30.

Combining equations 4 and 5, the number of refrigerant tubes 46 required for the first portion 42 of the fluid passageway 38 of the heat exchanger 26 operating as the evaporator may be expressed by the equation:

$$n_{evap}=\frac{COP\,n_{tot}}{1+COP} \tag{6}$$

Alternatively, combining equations 4 and 6, the number of refrigerant tubes 46 required for the first portion 42 of the fluid passageway 38 of the heat exchanger 26 operating as the evaporator may be expressed by the equation:

$$n_{evap} = \frac{\left(\frac{\dot{q}_{evap}}{\dot{q}_{comp}}\right) n_{tot}}{1 + \left(\frac{\dot{q}_{evap}}{\dot{q}_{comp}}\right)} \quad (7)$$

For example, equation 6 shows that the vapor compression system having a coefficient of performance (COP)=2, requires that two thirds (⅔) of the total number of refrigerant tubes 46 ($n_{tot}$) in the fluid passageway 38 of the heat exchanger 26 be apportioned to the first portion 42 of the fluid passageway 38 ($n_{evap}$); and the number of refrigerant tubes 46 apportioned to the second portion 44 of the fluid passageway 38 is one third (⅓) the total number of refrigerant tubes 46 ($n_{tot}$) in the fluid passageway 38 of the heat exchanger 26. This means that one third (⅓) of the total number of refrigerant tubes 46 ($n_{tot}$) must be cut off from the heat exchanger 26 when it is called upon to operate as an evaporator. This provides a guideline as to the location of the valve 48 of the heat exchanger 26 in this example.

The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A heat pump system operable in a heating mode and a cooling mode, said system comprising;

a compressor, an expansion device, a heat exchanger, a circuit interconnecting said compressor and said expansion device and said heat exchanger for directing a refrigerant therethrough in a direction, said circuit including a flow directing mechanism for changing the direction said refrigerant circulates through said circuit thereby changing the operation of said heat exchanger between one of an evaporator and a condenser to switch between the heating mode and the cooling mode, said heat exchanger defining a fluid passageway therethrough and including a bypass bisecting said fluid passageway into a first portion and a second portion and in fluid communication with said fluid passageway and said circuit, said heat exchanger including a valve interconnecting said first portion and said second portion of said fluid passageway and said bypass and including a condenser position for opening fluid communication between said first portion and said second portion and closing fluid communication between said fluid passageway and said bypass for directing said refrigerant through said fluid passageway when said heat exchanger is operable as the condenser and an evaporator position for closing fluid communication between said first portion and said second portion and opening fluid communication between said first portion and said bypass for directing said refrigerant back to said circuit and preventing said refrigerant from circulating through said second portion of said heat exchanger when said heat exchanger is operable as the evaporator.

2. A system as set forth in claim 1 wherein said heat exchanger includes a first heat exchanger and a second heat exchanger with said first heat exchanger operable as the evaporator in the cooling mode and the condenser in the heating mode and said second heat exchanger operable as the condenser in the cooling mode and the evaporator in the heating mode.

3. A system as set forth in claim 2 wherein said system includes a control mechanism operatively connected to said flow directing mechanism and said valve of said first heat exchanger and said valve of said second heat exchanger for controlling the position of said flow directing mechanism and said valve of said first heat exchanger and said valve of said second heat exchanger.

4. A system as set forth in claim 2 wherein said system includes an air movement device operatively connected to said control mechanism for supplying a flow of air across said first heat exchanger and said second heat exchanger.

5. A system as set forth in claim 4 wherein said air movement device includes a plurality of fans with at least one fan supplying the flow of air to said first heat exchanger and at least one other fan supplying the flow of air to said second heat exchanger with said control mechanism disconnecting at least one fan adjacent said second portion of said fluid passageway when said heat exchanger is operable as the evaporator.

6. A system as set forth in claim 1 wherein said fluid passageway includes a plurality of refrigerant tubes ($n_{tot}$) evenly distributed throughout said fluid passageway and said first portion of said fluid passageway includes a portion of said plurality of refrigerant tubes ($n_{evap}$) defined by the equation:

$$n_{evap} = \frac{\left(\frac{\dot{q}_{evap}}{\dot{q}_{comp}}\right) n_{tot}}{1 + \left(\frac{\dot{q}_{evap}}{\dot{q}_{comp}}\right)}$$

where $\dot{q}_{evap}$ is defined as a heat absorption rate of said heat exchanger operable as the evaporator, and $\dot{q}_{comp}$ is defined as a heat generation rate of said compressor.

* * * * *